United States Patent [19]

Thomas

[11] 3,980,026

[45] Sept. 14, 1976

[54] SLIDE ASSEMBLY FOR EXTENDABLE TABLE

[75] Inventor: Paul P. Thomas, Bryan, Ohio

[73] Assignee: Winzeler Stamping Co., Montpelier, Ohio

[22] Filed: June 9, 1975

[21] Appl. No.: 585,267

[52] U.S. Cl. ..... 108/83; 308/3.6; 248/188.1

[51] Int. Cl.[2] ..... A47B 1/08

[58] Field of Search ..... 248/165, 172, 188.1; 108/13, 83, 159; 308/3.6; 312/341 NR, 348; 52/645; 403/104

[56] References Cited

UNITED STATES PATENTS

| | | | |
|---|---|---|---|
| 2,606,091 | 8/1952 | Buchy et al. | 312/348 |
| 2,733,972 | 2/1956 | Diack | 312/348 |
| 3,320,003 | 5/1967 | Edelson et al. | 308/3.6 |
| 3,649,090 | 3/1972 | Dutot | 308/3.6 |
| 3,769,919 | 11/1973 | Thomas | 108/83 |
| 3,871,780 | 3/1975 | Svensson | 403/104 |

*Primary Examiner*—Robert A. Hafer
*Attorney, Agent, or Firm*—Reising, Ethington, Barnard, Perry and Brooks

[57] ABSTRACT

An extendable table of the disclosure includes an extendable frame having laterally spaced slide assemblies extending between opposite ends thereof so as to be capable of supporting table tops of different lengths. Each slide assembly includes a pair of elongated hollow female beams projecting from opposite ends of the frame and having open ends that receive the opposite ends of an elongated male support member which aligns and slidably interconnects the beams with each other in cooperation with an improved pad arrangement. The pad arrangement permits the support member and beams to have their elongated axes unaligned as the support member is inserted into the beams and the support member is maintained within the beams by a snap action locking that secures certain pads of the arrangement to the open ends of the beams. The support member is positioned in a spaced relationship with respect to the cross-sections of the beams to permit sliding movement therebetween despite variance in the size of these components along their axial lengths.

15 Claims, 9 Drawing Figures

SLIDE ASSEMBLY FOR EXTENDABLE TABLE

BACKGROUND OF THE INVENTION

1. Field of the Invention

This invention relates to an extendable table including an extendable frame for supporting table tops of different lengths, and is more particularly directed toward laterally spaced slide assemblies of the frame that interconnect the opposite ends thereof to permit the frame adjustment.

2. Description of the Prior Art

U.S. Pat. No. 3,769,919, issued Nov. 6, 1973 and assigned to the assignee of the present invention, discloses and claims an extendable table that may be sold with table tops of different lengths in accordance with customer preference. This table includes an extendable frame having laterally spaced slide assemblies that interconnect the opposite ends of the frame to permit its positioning for use with either short or long table tops. Each of the slide assemblies includes a pair of hollow female beams projecting from opposite ends of the frame and having open ends that receive the opposite ends of an elongated male support member to provide a slidable interconnection between the beams. Each end of the male support member includes a multi-sided pad assembly of multiple components secured thereto and each beam likewise includes such a pad assembly. These pad assemblies rigidify the slidable connection provided between the beams in both shortened and elongated positions of the table. The construction of the pad assemblies requires that the male support member have its elongated axis aligned in a parallel relationship with the elongated axis of each female beam upon insertion into the beam.

The pad assemblies of the table described above are necessary due to dimensional variances in the stock material from which the male support member and the female beams are constructed. The elongated configurations of these components and their dimensional variances along their lengths thus necessitate the use of some type of pad arrangement for slidably interconnecting them at spaced positions along their lengths. Whatever the construction of the pad arrangement that is utilized, its cost of manufacture will necessarily be reflected in the selling price of the completed table and a reduction of this cost is desirable to make the table have a competitive price in the marketplace.

SUMMARY OF THE INVENTION

An extendable table embodying the present invention includes an extendable frame having a pair of laterally spaced slide assemblies extending between opposite ends thereof, and each slide assembly incorporates an improved pad arrangement for slidably supporting the opposite ends of a male support member which is received by the open ends of a pair of hollow female beams projecting from the opposite ends of the frame.

One feature of the invention is that each male support member of the extendable table slide assemblies has a first pad projecting downwardly from each of its extreme ends to slidably engage a bottom wall of the associated female beam in which it is received, and a second pad associated with each support member end has upper and lower portions between which the support member is slidably supported as well as a locking portion that snaps into a locking relationship with a locking portion on the bottom wall of the beam to thereby secure the second pad to the beam so that it may cooperate with the first pad in rigidifying the slidable connection between the beam and the support member.

Another feature of the invention is that each slide assembly of the extendable table includes: a first pad projecting vertically from each extreme end thereof to slidably engage the interior of the female beam in which it is received; a second pad secured to the open end of each female beam after insertion of the associated support member end thereinto, this second pad including an upper pad portion that slidably engages the upper side of the inserted support member; and a third pad secured to each support member end spaced inwardly from the first pad and projecting in a vertical direction opposite thereto so as to slidably engage the interior of the associated beam to cooperate with the other two pads in rigidifying the slidable connection between the beam and the associated support member end.

Other features, objects and advantages of an extendable table embodying the invention are included in a preferred construction wherein the male support member and the female beams have rectangular cross-sections and the three pads associated with each end of the support member include side portions for positioning the support member laterally intermediate the side walls of the beam. The first and third pads are welded to the support member and have generally U-shaped configurations. The U-shaped configuration of the first pad opens upwardly so that its closed end projects downwardly to slidably engage a bottom wall of the associated beam. The U-shaped configuration of the third pad opens downwardly so that its closed end projects upwardly to engage a top wall of the beam. The second pad also has a generally U-shaped configuration that opens downwardly so that its closed end provides the upper pad portion that slidably engages the upper side of the support member. One side portion of the second pad is integrally connected to the lower pad portion that slidably supports the lower side of the support member by extending inwardly from the pad side portion to which it is integrally connected. The inner end of the lower pad portion has the locking portion of the second pad integrally connected thereto and projecting downwardly. The locking portion of the second pad is received within an open ended slot in the bottom wall of the associated female beam, and the open end of this slot is partially closed by a locking portion of the beam over which the locking portion of the pad is resiliently deflected so as to be snapped into a locking relationship that secures this pad to the beam. The locking portion of the beam includes a ramp surface that resiliently deflects the locking portion of the second pad.

The snap action locking of the second pad to the open end of its associated female beam provides a simplified assembly operation for securing the slidable interconnection between the beam and its associated support member end. The spacing between the first and third pads and the manner in which they project in opposite vertical directions permit the support member end to be inserted into the beam with its elongated direction skewed with respect to the elongated direction of the beam. The support member is automatically aligned with the beam upon its insertion so that both of the vertically projecting pad portions engage associated top and bottom walls of the beam. The third pad also engages the second pad to function as a stop that limits outward sliding movement of the support member end from its associated beam so as to insure that the support member has a sufficient cantilever length within the beam to provide its rigidified interconnection therewith.

The open ends of the female beams of each slide assembly abut each other when the table is used in a shortened position to support a table top of a relatively short length. The beams include tangs projecting upwardly from their bottom walls adjacent the opposite ends of the support member to provide centering thereof in this shortened table position. Movement of the table to an elongated position thereof exposes the support members extending between their associated beams, and covers are positioned over the support members to provide continuity to the outer aesthetic appearance of the beams as well as supporting structure for the intermediate portion of an elongated table top supported by the table.

The above features and other features as well as the objects and advantages of the present invention are readily apparent from the following detailed description of the preferred embodiment taken in connection with the accompanying drawings.

DETAILED DESCRIPTION OF THE PREFERRED EMBODIMENT

Figure 1:
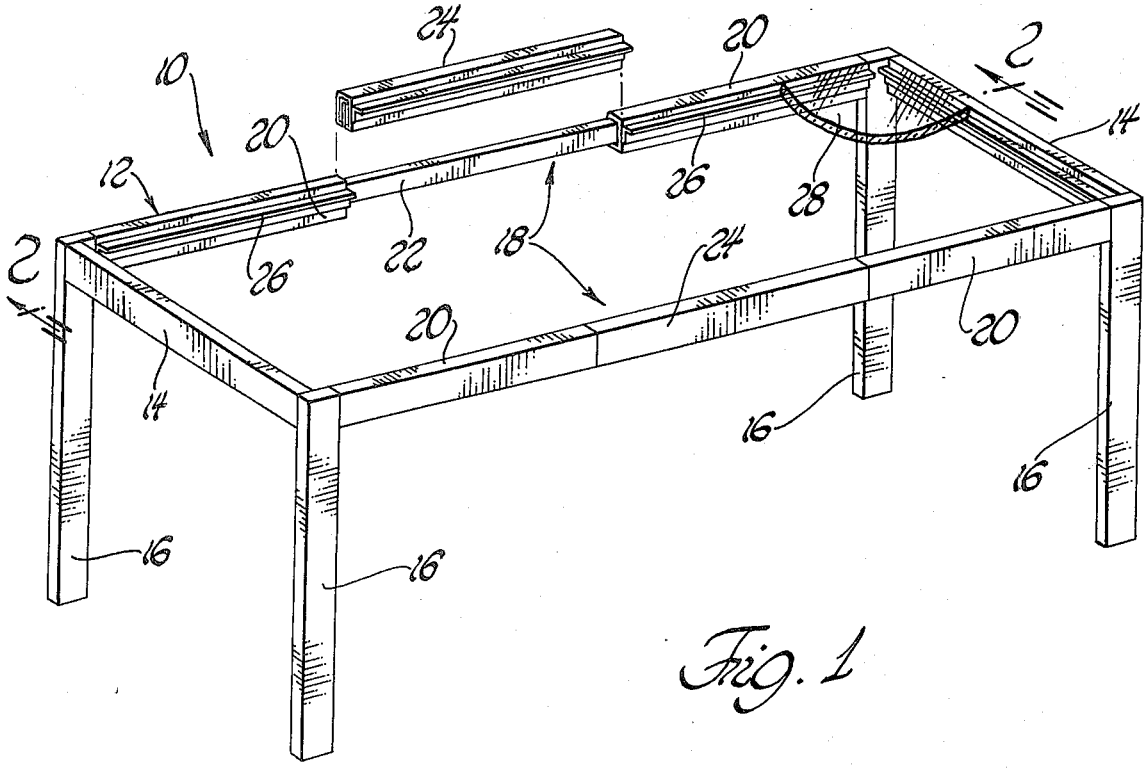
FIG. 1 is a perspective view of an extendable table embodying the invention.

With reference to FIG. 1, an extendable table embodying the invention is indicated by numeral 10 and includes an extendable frame 12 of an elongated configuration. Opposite ends of the frame 12 include laterally extending horizontal beams 14 as well as downwardly projecting legs 16 whose upper ends are interconnected by the laterally extending beams. A pair of laterally spaced slide assemblies indicated by reference numeral 18, and illustrated best in FIGS. 2 and 3, interconnect the opposite ends of the table frame. Each slide assembly includes a pair of hollow female beams 20 that are elongated and have first ends secured to associated ends of the table frame and second ends that open toward each other to receive the opposite ends of an elongated male support member 22 of the slide assembly. When the table is utilized in its elongated position, shown by FIGS. 1 and 2, the exposed support member 22 of each slide assembly is covered by an associated cover 24 to provide continuity to the aesthetic appearance between the female beams 20. The open ends of the female beams 20 abut each other when the table is utilized in its shortened position as shown in FIG. 3. The support member 22 provides a rigidified interconnection between the female beams 20 of each slide assembly so that the table may be utilized in either its elongated or shortened position. Flanges 26 on the beams 14 and 20 and on the covers 24 provide a supporting surface for the table top 28, shown partially in FIG. 1, which has a length corresponding to the length of the table its purchaser desires and which is preferably made from sheet glass.

Figure 2:
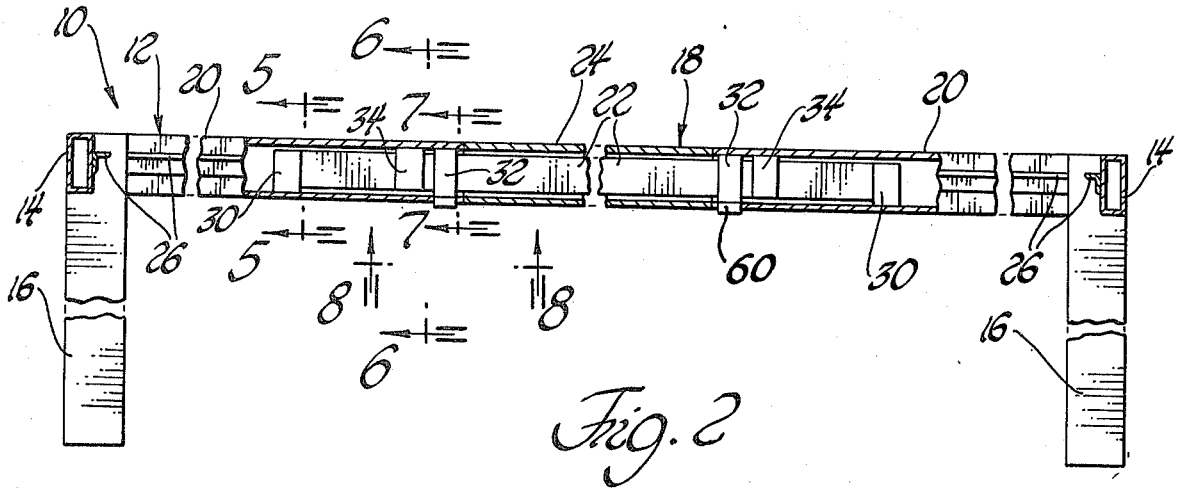
FIG. 2 is a partial sectional view taken approximately along line 2—2 of FIG. 1 and illustrates a lateral slide assembly which connects opposite ends of the table frame to position the frame in the elongated position shown.
Figure 3:
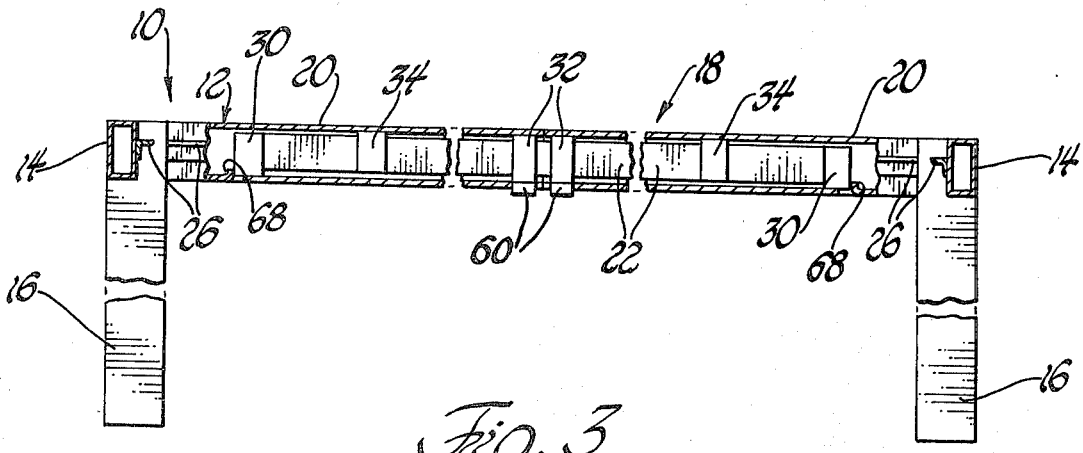
FIG. 3 is a view similar to FIG. 2 but with the table frame shown in a shortened position thereof where it is capable of supporting shorter table tops than in FIG. 2.
Figure 4:
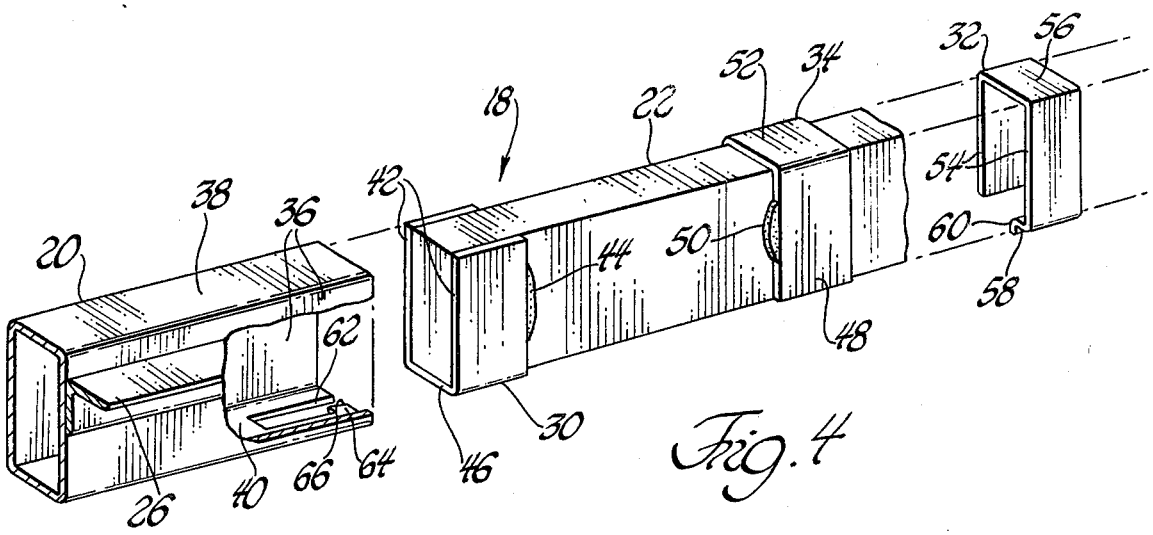
FIG. 4 is an exploded perspective view of the slide assembly, illustrating a male support member and pads associated therewith for providing slidable interconnection thereof with a hollow beam in which the support member is received.

With combined reference to FIGS. 2 through 4, each slide assembly 18 includes pads 30, 32, and 34 associated with each end of the male support member 22 and the female beam 20 in which the support member end is received. These pads are used to rigidify the interconnection between the support member and the beam and to permit a slidable adjustment that allows the table to be utilized either in its elongated position of FIGS. 1 and 2 or its shortened position of FIG. 3. Each female beam 20 is made from metallic material and has a rectangular cross-section that is elongated in a vertical direction so that, as seen in FIG. 4, the hollow construction of the beam defines side walls 36, a top wall 38, and a bottom wall 40. The male support member 22 is also made from metallic material and likewise has a vertically elongated rectangular cross-section, but of a slightly smaller size than the interior of the female beam so as to be capable of insertion into the beam.

Figure 5:
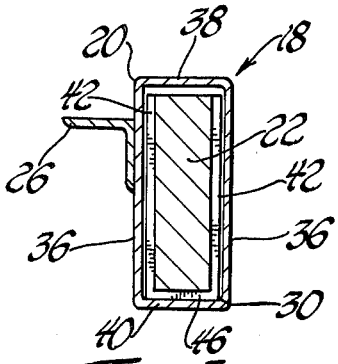
FIGS. 5, 6, and 7 are sectional views through the slide assembly respectively taken along lines 5—5, 6—6, and 7—7 of FIG. 2 and show the manner in which the pads provide slidable interconnection between the support member and the beam.

The pad 30 on each extreme end of support member 22 has a generally U-shaped configuration including side portions 42 which, as seen in FIG. 4, are secured to the support member 22 by welds 44. The U-shaped configuration of pad 30 opens upwardly so that its closed lower end 46 projects downwardly from the lower side of the support member and engages the bottom wall 40 of beam 20 upon insertion through its open end. This engagement maintains a spaced relationship between the lower side of the support member 22 and the bottom beam wall 40, as seen in FIG. 5. The side portions 42 of the pad 30 likewise space the support member 22 laterally intermediate the side walls 36 of the beam.

Figure 6:
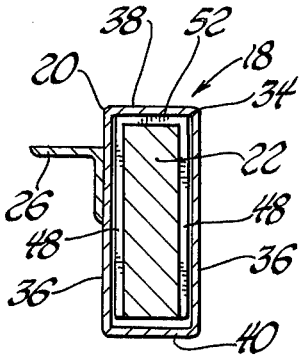

Each pad 34 also has a generally U-shaped configuration including side portions 48 that are secured to the support member 22 by welds 50 at a location spaced inwardly from the pad 30. The U-shaped configuration of pad 34 opens downwardly so that its closed upper end 52 projects upwardly from the support member and, as seen in FIG. 6, engages the inner side of the top beam wall 38 to maintain a spaced relationship between the support member and this wall. The side portions 48 of pad 34 engage the side walls 36 of the beam so as to locate the support member in a spaced relationship laterally intermediate these walls in a cooperable manner with the side portions 42 of pad 30. The manner in which the pads 30 and 24 are spaced with respect to each other along the length of support member 22 and project vertically therefrom in opposite directions permits the support member 22 to be inserted into the beam with its elongated direction oriented in a skewed relationship with respect to the elongated direction of the beam. If these pads completely encircled the support member at the same axial position rather than in the oppositely projecting and axially spaced relationship herein disclosed, the elongated axes of the beam and the support member would have to be maintained in a parallel relationship to permit the insertion of the support member into the beam. Rather, the pad construction shown in FIG. 4 permits the support member 22 to be inclined downwardly from its extreme end during the insertion into the beam 20. As the insertion proceeds, the bottom wall 40 at the open end of beam 20 engages the bottom side of the support member 22 and causes a lifting action that automatically aligns the elongated direction of the support member in a generally parallel relationship with the elongated direction of the beam. This automatic alignment facilitates the assembly operation of the components of slide assembly 18.

Figure 7:
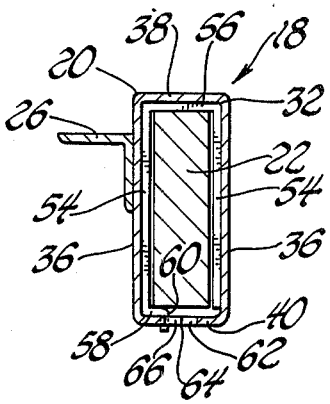
Figure 8:
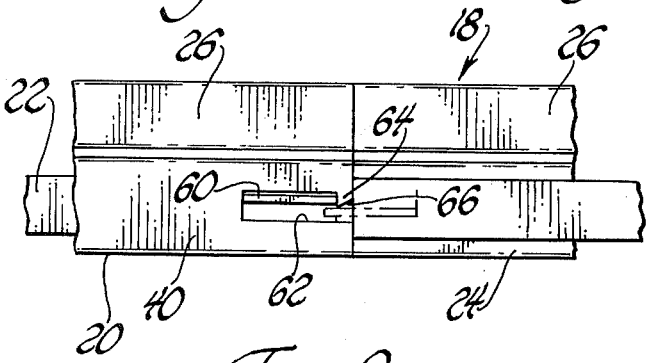
FIG. 8 is a bottom plan view taken along line 8—8 of FIG. 2.

Each pad 32 of the slide assemblies 18 is secured to the open end of its associated female beam 20 after the adjacent end of support member 22 has been inserted into the beam. The pad 32, as seen best by reference to FIGS. 4 and 7, has a generally U-shaped configuration that opens downwardly and includes side portions 54 as well as an upper closed end which provides an upper portion 56 for the pad. One of the side portions 54 has its lowered end integrally connected to a lower portion 58 of the pad that extends laterally inwardly as seen in FIG. 7. The inner end of lower pad portion 58 is integrally connected to a locking portion 60 of the pad which projects downwardly. The bottom wall 40 of female beam 20 defines an open ended slot 62 at the open end of the beam, as best seen by reference to FIGS. 4 and 8, and the outer end of this slot is partially closed by a locking portion 64 of the beam defined by its bottom wall. The beam locking portion 64 includes a ramp surface 66 that engages the locking portion 60 of the pad 32 as this pad is inserted into the open end of the beam between the beam and the support member. The ramp surface 66 deflects the locking portion 60 and resiliently deforms the pad so that a snap action occurs as the pad locking portion moves from its phantom line position of FIG. 8 to its solid line position into a locking relationship with the beam. The locking portion 60 of pad 32 is thus located between the closed end of the slot 62 and the beam locking portion 64 in this locking relationship. The upper and lower portions 56 and 58 of the secured pad 32, as seen in FIG. 7, slidably engage the upper and lower sides of the support member 22 to maintain the support member in a spaced relationship with respect to the top and bottom beam walls 38 and 40. Likewise, the side portions 54 of the pad 32 also position the support member 22 in a spaced relationship laterally intermediate the side walls 36 of the beam. The rigidified interconnection between the support member and the beam in the vertical plane is more important than in the lateral plane and more spacing is possible in this lateral direction than in the vertical direction. This lateral spacing is necessary to permit deflection of pad 32 that permits this pad to be secured to the beam by its snap action into its locking relationship.

Figure 9:
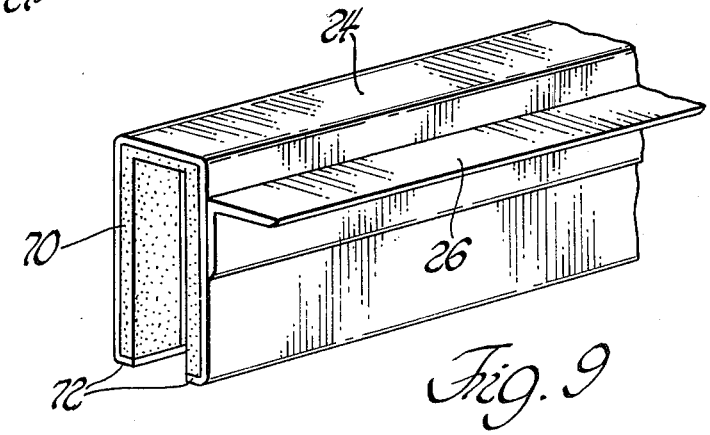
FIG. 9 is a perspective view illustrating a cover that is utilized over the support member in the elongated position of the table.

When the table is utilized in its shortened position of FIG. 3, tangs 68 bent upwardly from the bottom walls of beams 20 center the support member 22 that extends between these beams. Movement of the table to its elongated position of FIG. 2 causes the pads 34 secured to the support member to engage the pads 32 secured to the open ends of the beams and thereby limits the outward sliding of the support member with respect to the beams. Consequently, the pads 30 at the extreme ends of the support member are insured of being positioned far enough into their associated beams so as to have a sufficient cantilever length from the open ends of the beams to prevent a downward force on the center of the frame from bowing the frame downwardly. The covers 24 positioned over the support members 22 in the elongated table position have pads 70, FIG. 9, that position the covers with respect to their associated support members. These pads 70 have downwardly opening U-shaped configurations whose lower ends are secured in position by spaced lower flanges 72 along the length of the covers.

While a preferred embodiment of the extendable table has been described, those skilled in the art will recognize various alternative constructions and designs for practicing the present invention as defined by the following claims.

What is claimed is:

1. An extendable table comprising: an extendable frame for supporting table tops of different lengths; the frame including a pair of laterally spaced slide assemblies interconnecting opposite ends thereof; each slide assembly including an elongated female beam of a hollow construction secured to one end of the frame so that one end of the beam opens toward the other end of the frame; each slide assembly also including an elongatd male support member of a smaller cross-section than the interior of the female beam; the male support member having a first end received within the open end of the female beam and a second end secured to the other end of the frame; the female beam including a bottom wall which defines an opening having an end that opens toward the other end of the frame and a closed end located toward the one end of the frame from the open end of the opening; said bottom wall including a locking portion that partially closes the open end of the opening; a downwardly projecting first pad on the first end of the male support member, said first pad engaging the interior of the bottom wall of the female beam after insertion of the support member into the beam; and a second pad having a locking portion that is resiliently snapped over the locking portion of the beam into a locking relationship between the locking portion of the beam and the closed end of the opening to secure the second pad to the beam after insertion of the support member thereinto, the second pad also having upper and lower portions between which the support member is received to cooperate with the first pad in maintaining a parallel relationship between the elongated directions of the beam and the support member during use of the table, and the pads permitting sliding movement between the support member and the beam to vary the length of the frame between its opposite ends and the corresponding length of a table top that may be supported by the frame.

2. A table according to claim 1 wherein the first and second pads each include side portions that position the support member in a spaced relationship laterally intermediate the beam cross-section.

3. A table according to claim 1 wherein the female beam and male support member are elongated in a rectilinear manner and each have cross-sections that are rectangular in a vertically elongated manner so the hollow beam includes top, bottom and side walls.

4. A table according to claim 3 wherein the first pad has a generally U-shaped configuration whose closed end projects downwardly to engage the bottom wall of the beam, the first pad having side portions that engage the side walls of the beam to position the support member in a spaced relationship laterally intermediate the side walls, and the first pad being welded to the support member.

5. A table according to claim 4 wherein the upper portion of the second pad has side portions extending downwardly therefrom on opposite sides of the support member to position the support member laterally intermediate the side walls of the beam, at least one side portion of the second pad being connected at a lower end thereof to the lower portion of the second pad, the lower portion of the second pad projection laterally inwardly and being connected at its inner end to the locking portion of the second pad, and the locking portion of the second pad projecting downwardly to cooperate with the locking portion of the beam in securing the second pad to the beam.

6. A table according to claim 1 wherein the locking portion of the beam has a ramp surface that resiliently deflects the locking portion of the second pad upon movement of the latter into the slot of the beam.

7. A table according to claim 1 wherein each slide assembly also includes a second female beam secured to the other end of the frame and having an open end receiving a second end of the support member, with first and second pads associated therewith in the same manner as the other beam and the first end of the support member to provide a slidable interconnection therebetween that secures the second end of the support member to the other end of the frame.

8. A table according to claim 7 wherein covers are positioned over the support members of each slide assembly intermediate the open ends of their associated beams.

9. An extendable table comprising: an extendable frame for supporting table tops of different lengths; the frame including a pair of laterally spaced slide assemblies interconnecting opposite ends thereof; each slide assembly including an elongated female beam of a hollow construction secured to one end of the frame so that one end of the beam opens toward the other end of the frame; each slide assembly also including an elongated male support member of a smaller cross-section than the interior of the female beam; the male support member having a first end received within the open end of the female beam and a second end secured to the other end of the frame; a first pad projecting vertically from the extreme first end of the support member in one direction to engage the interior of the beam after insertion thereinto; a second pad secured to the open end of the beam after insertion of the support member and having an upper portion that engages the inserted male support member from above; and a third pad that projects vertically from the male support member in an opposite direction to the first pad to engage the interior of the beam, the third pad being axially spaced along the length of the support member inwardly from the extreme end thereof so the support member may be inserted into the beam with its elongated direction unaligned with the elongated direction of the beam, the third pad being spaced from the interior of the beam in the one direction and the first pad being spaced from the interior of the beam in the other direction, the pads cooperating to maintain a parallel relationship between the elongated directions of the beam and the support member during use of the table and to permit sliding movement therebetween that varies the frame length and the corresponding table top length that may be supported thereby, and the third pad engaging the second pad to limit the outward sliding of the support member with respect to the beam.

10. A table according to claim 9 wherein the first pad projects downwardly at the extreme end of the support member and the third pad projects upwardly at its axially spaced location inwardly from said extreme end.

11. A table according to claim 9 wherein the first and third pads are welded to the support member and the second pad is secured to the open end of the female beam by a snap action in a locking relationship.

12. A table according to claim 9 wherein each of the three pads has a pair of side portions that cooperate to position the support member laterally intermediate the cross-section of the beam in a spaced relationship with respect thereto.

13. A table according to claim 9 wherein each slide assembly also includes a second female beam secured to the other end of the frame and having an open end receiving a second end of the support member with first, second and third pads associated therewith in the same manner as the other beam and the first end of the support member to provide a slidable interconnection that secures the second end of the support member to the other end of the frame.

14. A table according to claim 13 wherein covers are positioned over the support members of each slide assembly intermediate the open ends of their associated beams.

15. An extendable table comprising: an extendable frame for supporting table tops of different lengths; the frame including a pair of laterally spaced slide assemblies interconnecting opposite ends thereof; each slide assembly including an elongated female beam of a hollow construction secured to one end of the frame so that one end of the beam opens toward the other end of the frame; each slide assembly also including an elongated male support member of a smaller cross-section than the interior of the female beam; the male support member having a first end received within the open end of the female beam and a second end secured to the other end of the frame; the female beam including a bottom wall which defines a locking portion adjacent the open end of the female beam; a downwardly projecting first pad on the first end of the male support member, said first pad engaging the interior of the bottom wall of the female beam after insertion of the support member into the beam; and a second pad having a locking portion, one of said locking portions having a ramp surface that engages the other locking portion during insertion of the second pad into the female beam so that the locking portion of the second pad is resiliently snapped over the locking portion of the beam into a locking relationship to secure the second pad to the beam after insertion of the support member thereinto, the second pad also having upper and lower portions between which support member is received to cooperate with the first pad in maintaining a parallel relationship between the elongated directions of the beam and the support member during use of the table, and the pads permitting sliding movement between the support member and the beam to vary the length of the frame between its opposite ends and the corresponding length of a table top that may be supported by the frame.

* * * * *